US012352123B2

(12) United States Patent
Robertson et al.

(10) Patent No.: US 12,352,123 B2
(45) Date of Patent: Jul. 8, 2025

(54) BOREHOLE CONDUIT CUTTING APPARATUS WITH SWIRL GENERATOR

(71) Applicant: Robertson Intellectual Properties, LLC, Arlington, TX (US)

(72) Inventors: Michael C. Robertson, Mansfield, TX (US); Antony F. Grattan, Arlington, TX (US)

(73) Assignee: Robertson Intellectual Properties, LLC, Mansfield, TX (US)

( * ) Notice: Subject to any disclaimer, the term of this patent is extended or adjusted under 35 U.S.C. 154(b) by 486 days.

(21) Appl. No.: 17/856,664

(22) Filed: Jul. 1, 2022

(65) Prior Publication Data

US 2024/0003210 A1 Jan. 4, 2024

(51) Int. Cl.
*E21B 29/02* (2006.01)
*F23R 3/14* (2006.01)

(52) U.S. Cl.
CPC ..... *E21B 29/02* (2013.01); *F23R 3/14* (2013.01)

(58) Field of Classification Search
CPC ..... E21B 29/02; E21B 31/00; E21B 41/0078; E21B 43/117; F23R 3/14; F23R 3/12
See application file for complete search history.

(56) References Cited

U.S. PATENT DOCUMENTS 2,680,486 A * 6/1954 Carpenter ..... E21B 29/02 148/201
4,446,920 A * 5/1984 Woytek ..... E21B 43/114 166/55
4,540,055 A * 9/1985 Drummond ..... E21B 21/16 175/323
4,619,318 A * 10/1986 Terrell ..... E21B 29/02 166/212
10,724,320 B2 * 7/2020 Huang ..... E21B 29/02
10,781,676 B2 * 9/2020 Huang ..... E21B 43/114
2005/0072568 A1 * 4/2005 Robertson ..... E21B 29/02 166/297
2006/0201675 A1 * 9/2006 Ferguson ..... E21B 34/10 166/298
2009/0227185 A1 * 9/2009 Summers ..... B24C 11/005 451/39
2017/0241227 A1 * 8/2017 Tallini ..... C06B 33/02
2017/0335646 A1 * 11/2017 Huang ..... E21B 43/11
(Continued)

*Primary Examiner* — Daniel P Stephenson
(74) *Attorney, Agent, or Firm* — McCutcheon Joseph, PLLC

(57) ABSTRACT

An apparatus for severing a conduit in the borehole includes a combustible fuel; a nozzle section comprising a cavity with apertures providing passages from the cavity to outside the apparatus; a movable swirl generator located between the combustible fuel and the nozzle section, the swirl generator comprising a piston and a plurality of helical vanes, the piston located initially above the apertures; and an activation device for igniting the combustible fuel for creating a matrix of combustion products that pass between and/or along the helical vanes and move the swirl generator in the cavity so that the piston is moved below the apertures for passage of the matrix of combustion products into the cavity and out of the apertures. The helical vanes rotate the matrix of combustion products and direct the rotating matrix of combustion products radially through of the apertures for cutting the conduit.

20 Claims, 8 Drawing Sheets

(56) References Cited

U.S. PATENT DOCUMENTS

| | | | | |
|---|---|---|---|---|
| 2019/0063173 | A1* | 2/2019 | Tallini | F42D 1/045 |
| 2019/0186243 | A1* | 6/2019 | Huang | E21B 43/1185 |
| 2020/0291734 | A1* | 9/2020 | Schultz | E21B 17/023 |

* cited by examiner

BOREHOLE CONDUIT CUTTING APPARATUS WITH SWIRL GENERATOR

FIELD

The present invention relates, generally, to an apparatus and methods for cutting or severing a conduit located in a borehole formed in the earth. In particular, the invention relates to an apparatus and methods that generate a degree of rotation of the apparatus created by thrust through helical diversion of a matrix of combustion products for cutting the conduit.

BACKGROUND

Inuring drilling operations of an oilfield well, a drill pipe may become stuck in the borehole of the well. In such a case, remedial action is required to remove an upper portion of the drill pipe, so that the lower portion of the drill pipe can be drilled out. To recover a portion of the stuck drill pipe, it is common practice to use a pipe cutting device to cut the pipe in the pipe string immediately above where the drill pipe is stuck. Several apparatuses for cutting pipe in a borehole are known. Those apparatuses typically have an activation device, combustible material, and a nozzle. The activation device ignites the combustible material to form a matrix of combustion products that is discharged through the nozzle. The nozzle directs the matrix of combustion products outward to impinge upon a pipe wall for severing the pipe.

When using conventional apparatus and methods, sometimes problems occur in that the cutting pattern on the pipe from the matrix of combustion products is not uniform, and the cut becomes uneven. Furthermore, there is a risk that the matrix of combustion products has an over-cutting potential when the matrix of combustion products exits the nozzle. This is due to the focused and directional nature of distributed matrix of combustion products. Moreover, webbing between apertures of a nozzle can prevent portions of the pipe from being impacted by the matrix of combustion products exiting the apertures, resulting in undesirable "webbing effects" in which portions of the pipe at locations corresponding to the webbing are not cut. Existing cutting and severing apparatus have thus experienced problems with the lack of uniformity of the cutting or severing procedure.

A need exists for apparatuses and methods for cutting or severing a conduit located downhole in a borehole formed in the earth, which create a more even cutting pattern, minimize over-cutting potential, and reduce or eliminate webbing effects.

The present invention meets these needs.

SUMMARY

The embodiments disclosed herein address the non-uniform distribution of combustion products by introducing a rotational component to the cutting apparatus during the discharge of the combustion products. By providing a degree of rotation, the discharge of combustion products is rotated radially around a circumferential plane of cutting, thereby resulting in a more even and uniformly distributed discharge. By achieving an even discharge of combustion products, the cutting performance is precisely controlled and results in less damage to adjacent tubular members within the wellbore (e.g., minimizes over-cut potential).

Embodiments of the apparatuses disclosed herein include a swirl generator located downstream of a combustible fuel. The swirl generator may comprise a plurality of helical vanes which extend from a domed end of the swirl generator toward an opposite end of the swirl generator. When a matrix of combustion products is created by ignition of combustible fuel, the matrix of combustion products may be passed between and/or along the helical vanes of the swirl generator. The helical vanes may be shaped to rotate the matrix of combustion products and direct the rotating matrix of combustion products radially outward of the apparatus for cutting a conduit. A rotational thrust is imparted through the helical vanes thereby creating a reverse thrust component that acts upon the cutting apparatus. This reverse rotational thrust creates a degree of rotation about the axis of the cutting apparatus, and results in a more even cutting pattern that also minimizes over-cutting potential due to the uniformity of the discharge acting on the surface of the pipe and reduces or eliminates webbing effects.

Embodiments of the methods disclosed herein may involve flowing a matrix of combustion products between and/or along helical vanes of a swirl generator, so that the helical vanes rotate the matrix of combustion products and direct the rotating matrix of combustion products radially outward toward the conduit. The nozzle directs the matrix of combustion products, via a helical swirl generator, outward to impinge upon a pipe wall for cutting or severing the pipe. The rotational thrust generated via the swirl generator produces a reverse rotational thrust on the cutting apparatus, with respect to the matrix of combustion products, producing a degree of rotation about the axis of the apparatus, improving the impingement about the pipe wall during the cutting process. That is, the rotational thrust is imparted through the vanes of the swirl generator that is coupled to the apparatus thereby creating a reverse thrust component that then acts upon the cutting apparatus. This reverse rotational thrust creates a degree of rotation about the axis of the cutting apparatus and results in a more even cutting pattern while also minimizing over-cutting potential due to the uniformity of the discharge acting on the surface of the pipe.

In an embodiment, the apparatus fir severing a conduit in a borehole may comprise: a body adapted to be lowered into the conduit and comprising a central axis; a combustible fuel located within the body; a nozzle section comprising a cavity with a plurality of apertures for providing passages from the cavity to outside of the body: a movable swirl generator located between the combustible fuel and the nozzle section, the swirl generator comprising a piston and a plurality of helical vanes which extend from one end of the swirl generator toward the piston, wherein the piston is located initially above the plurality of apertures; and an activation device for igniting the combustible fuel to create a matrix of combustion products that pass between and/or along the plurality of helical vanes and move the swirl generator in the cavity so that the piston is moved below the plurality of apertures for passage of the matrix of combustion products into the cavity and out of the plurality of apertures for severing the conduit, wherein each of the plurality of helical vanes is shaped to rotate the matrix of combustion products and direct the rotating matrix of combustion products radially through of the plurality of apertures for cutting the conduit in the borehole.

In an embodiment, the matrix of combustible products acts upon the helical vanes of the swirl generator to produce a rotational thrust which is imparted to the apparatus, which generates a rotational movement of the apparatus about the central axis.

In an embodiment, the rotational movement is between 1 degree and 30 degrees about the central axis.

In an embodiment, the swirl generator comprises at least two helical vanes.

In an embodiment, the combustible fuel is one of a solid, a liquid, and a gel.

In an embodiment, the combustible fuel is configured to be inserted into the body at a work site, to allow for the combustible fuel to be tailored to specific well conditions, operational requirements, and/or constraints.

In an embodiment, an end of the swirl generator that is opposite the piston is dome shaped.

In another embodiment, a method of cutting a conduit located in a borehole may comprise: combusting a material to produce a matrix of combustion products within an apparatus comprising a central axis; flowing the matrix of combustion products between and/or along a plurality of helical vanes of a swirl generator; moving, with a force of the matrix of combustion products, the swirl generator in a cavity of a nozzle section comprising plurality of apertures, so that a piston portion of the swirl generator moves below the plurality of apertures for passage of the matrix of combustion products from the swirl generator into the cavity and out of the plurality of apertures for severing the conduit, wherein the plurality of helical vanes rotate the matrix of combustion products and direct the rotating matrix of combustion products radially through of the plurality of apertures for cutting the conduit in the borehole.

In an embodiment, the matrix of combustible products acts upon the helical vanes of the swirl generator to produce a rotational thrust which is imparted to the apparatus, which generates a rotational movement of the apparatus about the central axis.

In an embodiment, the rotational movement is between 1 degree and 30 degrees about the central axis.

In an embodiment, the material that is combusted is one of a solid, a liquid, and a gel.

In an embodiment, the method further comprises: inserting the material that is combusted into the apparatus at a work site, to allow for the material to be tailored to specific well conditions, operational requirements, and/or constraints.

In a further embodiment, an apparatus for severing a conduit in a borehole comprises: a nozzle section comprising a cavity with a plurality of apertures for providing passages from the cavity to outside of the apparatus; and a swirl generator adjacent the nozzle section and comprising a piston and a plurality of helical vanes which extend from one end of the swirl generator to the piston, wherein the piston is located initially above the plurality of apertures, the swirl generator is configured to move in the cavity to position the piston below the plurality of apertures for passage of a matrix of combustion products into the cavity and out of the plurality of apertures for severing the conduit, and each of the plurality of helical vanes is shaped to rotate the matrix of combustion products, and direct the rotating matrix of combustion products radially through of the plurality of apertures when the piston is moved below the plurality of apertures.

In an embodiment, the apparatus further comprises a central axis, wherein the matrix of combustible products acts upon the helical vanes of the swirl generator to produce a rotational thrust which is imparted to the apparatus, which generates a rotational movement of the apparatus about the central axis.

In an embodiment, the rotational movement is between 1 degree and 30 degrees about the central axis.

In an embodiment, the swirl generator comprises at least two helical vanes.

In an embodiment, an end of the swirl generator that is opposite the piston is dome shaped.

In another embodiment, an apparatus for severing a conduit in a borehole comprises: a body adapted to be lowered into the conduit and comprising a central axis; a combustible fuel located within the body; a nozzle section comprising a plurality of apertures for providing passages to outside of the body; a swirl generator located within the nozzle section and comprising a plurality of helical vanes; an activation device for igniting the combustible fuel to create a matrix of combustion products; and a rupture disc located between the combustible fuel and the swirl generator, wherein the rupture disc is configured to break under a predetermined pressure from the matrix of combustion products and allow passage of the matrix of combustion products through the rupture disc and flow along the plurality of helical vanes of the swirl generator, and wherein each of the plurality of helical vanes is shaped to rotate the matrix of combustion products and direct the rotating matrix of combustion products radially through the plurality of apertures for cutting the conduit in the borehole.

In an embodiment, the matrix of combustible products acts upon the helical vanes of the swirl generator to produce a rotational thrust which is imparted to the apparatus, which generates a rotational movement of the apparatus about the central axis.

In an embodiment, the rotational movement is between 1 degree and 30 degrees about the central axis.

BRIEF DESCRIPTION OF THE DRAWINGS

In the detailed description of various embodiments usable within the scope of the present disclosure, reference is made to the accompanying drawings in which.

DETAILED DESCRIPTION

Before describing selected embodiments of the present disclosure in detail, it is to be understood that the present invention is not limited to the particular embodiments described herein. The disclosure and description herein is illustrative and explanatory of one or more presently preferred embodiments and variations thereof, and it will be appreciated by those skilled in the art that various changes in the design, organization, means of operation, structures and location, methodology, and use of mechanical equivalents may be made without departing from the spirit of the invention.

As well, it should be understood that the drawings are intended to illustrate and plainly disclose presently preferred embodiments to one of skill in the art, but are not intended to be manufacturing level drawings or renditions of final products and may include simplified conceptual views to facilitate understanding or explanation. As well, the relative size and arrangement of the components may differ from that shown and still operate within the spirit of the invention.

Moreover, it will be understood that various directions such as "upper", "lower", "bottom", "top", "left", "right", "uphole", "downhole", and so forth are made only with respect to explanation in conjunction with the drawings, and that components may be oriented differently, for instance, during transportation and manufacturing as well as operation. Because many varying and different embodiments may be made within the scope of the concept(s) herein taught, and because many modifications may be made in the embodiments described herein, it is to be understood that the details herein are to be interpreted as illustrative and non-limiting.

Figure 1:
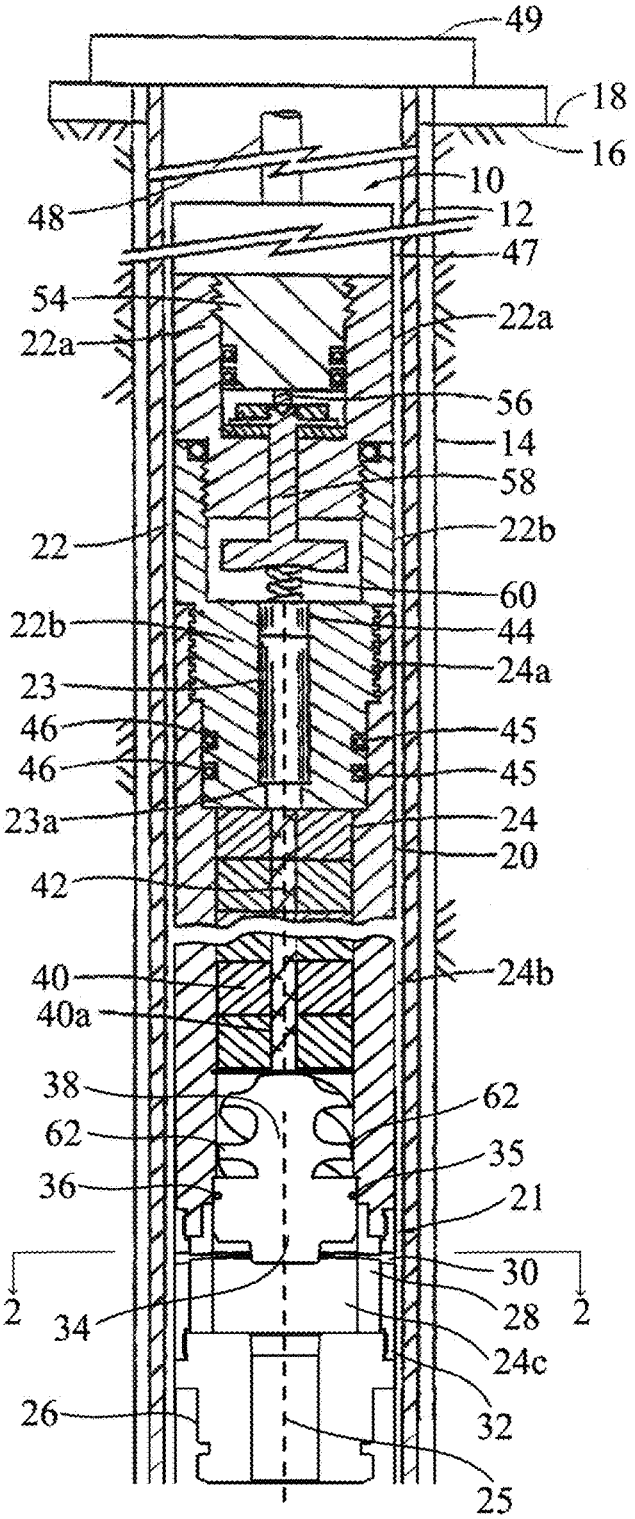
FIG. 1 illustrates a cross-sectional view of an apparatus for cutting a conduit, according to an embodiment.
Figure 2:
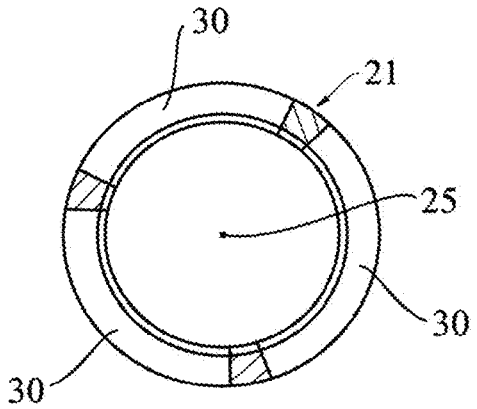
FIG. 2 is a cross-section of FIG. 1 taken along the lines 2-2 in FIG. 1.

FIG. 1 illustrates a cross-sectional view of an apparatus 10 for cutting or severing a conduit, such as a metal drill pipe 12, according to an embodiment. The apparatus 10 is shown located in the drill pipe 12 located in a borehole 14 extending into the earth 16 from the surface 18. One purpose of the apparatus 10 is to cut or sever the drill pipe 12 in the event it becomes stuck in the borehole 14, to allow remedial action. The apparatus 10 comprises an annular wall 20, which may be formed of metal according to one embodiment, and which may be formed into sections that attach together. One of the sections is a nozzle section. 21. The apparatus 10 further comprises an ignition subassembly 22 comprising members 22*a* and 22*b* that may be screwed together as shown to form, with the nozzle section 21, a chamber 24 having a central axis 25. The chamber 24 may comprise an upper chamber portion 24*a*, an intermediate chamber portion 24*b*, and a lower chamber portion 24*c* in the nozzle section 21. A cap 26 may be provided below the nozzle section 21. The lower chamber portion 24*c* defines a cylindrical cavity within the nozzle section 21, and may be provided with a heat resistant liner 28 formed of carbon. A plurality of elongated nozzle apertures 30 are formed through the heat resistant liner 28 and a head part 32 of the nozzle section 21. The elongated nozzle apertures 30 may be spaced apart about the central axis 25 as shown in FIGS. 1 and 2. Three elongated nozzle apertures 30 are shown in the embodiment of FIG. 2. In other embodiments however, two elongated nozzle apertures 30, or four or more elongated nozzle apertures 30 may be formed through the heat resistant liner 28 and the head part 32 in a plane perpendicular to the central axis 25.

A movable swirl generator 38 is located, in a first initial position, in the upper portion of the nozzle section 21. The swirl generator 38 comprises a plurality of helical vanes 62, discussed in detail below, and a cylindrical seal or piston 34. In some embodiments, the swirl generator 38 may be bonded to the piston 34, or may be pinned and bonded to the piston 34. The piston 34 may be formed of high strength steel. A scaling ring 35, such as an O-ring, may be provided in an annular slot 36 in the piston 34. The sealing ring 35, along with liquid pressure in the lower chamber portion 24*c*, may initially hold the swirl generator 38 in a first initial position above the elongated nozzle apertures 30. Liquid from the borehole 14 can flow into the lower chamber portion 24*c* by way of the elongated nozzle apertures 30 when the apparatus 10 is located in the borehole 14.

FIG. 1 also shows a fuel source 40 located in the intermediate chamber portion 24*b* of the chamber 24 and supported by an upper portion of the swirl generator 38, or by a temporary wall. In some embodiments the fuel 40 may be combustible material in the form of a solid, a liquid, or a gel. The combustible material may be non-explosive fuels such as thermites, modified thermites (containing gasification agents) or thermite mixtures containing binders, low explosives such as propellants and pyrotechnic compositions or modified liquid or gelled fuels with metal and/or metal oxide additives. In some embodiments, the non-explosive combustible fuels may be in the form of single or multiple stacked combustible pellets 40. e.g., thermite pellets. The pelletized fuel may be installed within the assembly prior to shipping. In other embodiments, the pelletized fuel may be installed in the assembly at the work site so that the mass of fuel can be adjusted to suit the specific well conditions, constraints, and operational requirements, such as hydrostatic pressure or changes to the cutting requirements.

With regard to non-explosive combustible pellets 40, e.g., thermite pellets, the pellets 40 may be compressed into a donut shape or toroidal configuration having a central hole, or pattern, such as a star shape, so as to increase the surface area of the central hole. In other embodiments, the combustible fuels may be in the form of powder, a liquid, or a gel, instead of pellets. In the illustrated embodiment, each of the combustible pellets 40 has a cylindrical outer surface and a central aperture 40*a* extending therethrough. The combustible pellets 40 are stacked on top of each other with the lowest pellets 40 supported by the swirl generator 38, or by a temporary wall, and with the central apertures 40*a* in alignment. Loosely packed combustible material 42, which may be of the same material used in forming the combustible pellets 40, can be located within the apertures 40*a* of the combustible pellets 40 such that each combustible pellet 40 is ignited from the loosely packed combustible material 42 upon ignition by an activation device 44. In another embodiment, the loose combustible material may not be present. In a further embodiment, the combustible material may be present in the form of a magnesium strip. The ignition means 44 is supported in a central aperture 23 of the ignition subassembly member 22*b* by a shoulder 23*a* of member 22*b*, the member 22*b* being screwed into the upper chamber portion 24*a* in the illustrated embodiment. The central aperture 23 may extend completely through the lower portion of member 22*b*. Member 22*b* may include sealing O-rings 45 located in annular grooves 46 as shown in FIG. 1. The activation device 44 can comprise an electrical resistor that is heated by an electrical current applied thereto from the surface 18.

Figure 3:
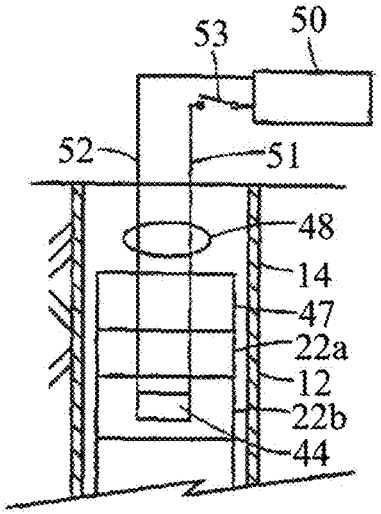
FIG. 3 schematically illustrates the electrical system of the apparatus of FIG. 1 according to an embodiment.

The member 22*a* may be coupled to a cable head assembly 47 in the embodiment illustrated in FIG. 1. A wireline cable 48 may be coupled to the upper end of the cable head assembly 47, and may extend to the surface 18 to a reel apparatus 49 which includes a reel employed for unwinding and winding the wireline cable 48 to lower and raise the apparatus 10. The reel apparatus 49 may also include a source 50 of electrical power (see FIG. 3) for applying electrical current to the activation device 44 by way of electrically insulated lead 51 of the wireline cable 48 as shown schematically in FIG. 3. Lead 52 (see FIG. 3) may be an electrically insulated ground or return lead coupled to the activation device 44. An uphole switch shown schematically at 53 (see FIG. 3) may be employed to couple and uncouple the source 50 to and from the activation device 44 to energize and de-energize the activation device 44. Lead 51 may be electrically coupled to the activation device 44 by way of an electrode probe 54, a prong 56, a conductor 58, and a spring 60. The electrode probe 54, prong 56, conductor 58, and spring 60 may be electrically insulated to prevent a short from occurring. This ignition system may be defined as an electric line firing system. When the activation device 44 is energize by electrical current, the activation device 44 generates enough heat to ignite the combustible material 42 and hence the pellets 40 to generate a very high temperature matrix of combustion products and pressure.

Figure 4:
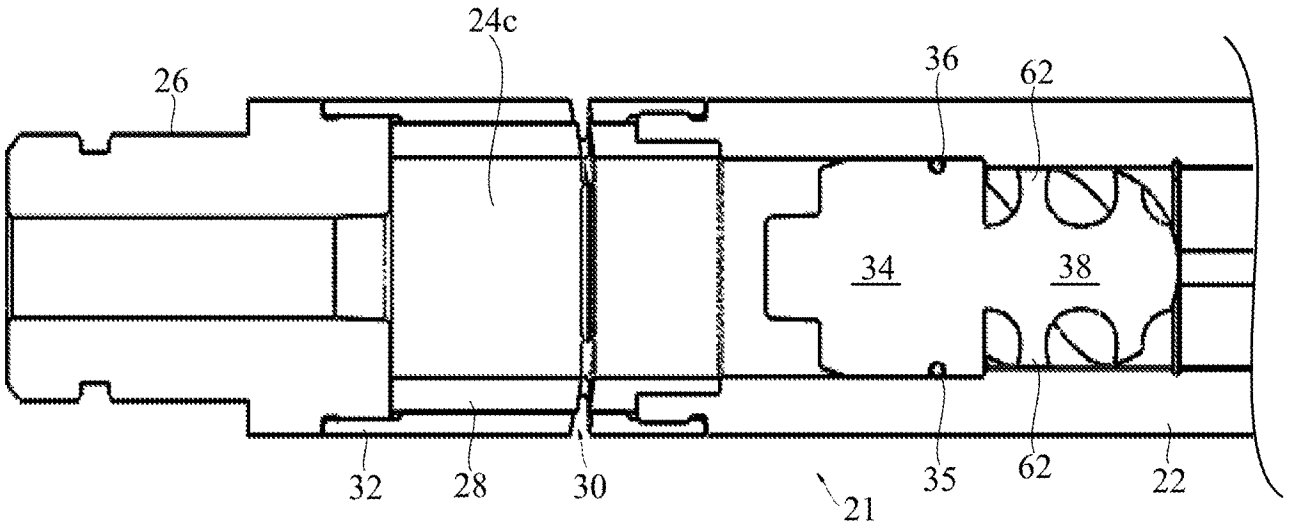
FIG. 4 is an enlarged cross-sectional view of the nozzle section of the apparatus shown in FIG. 1, according to an embodiment.
Figure 7:
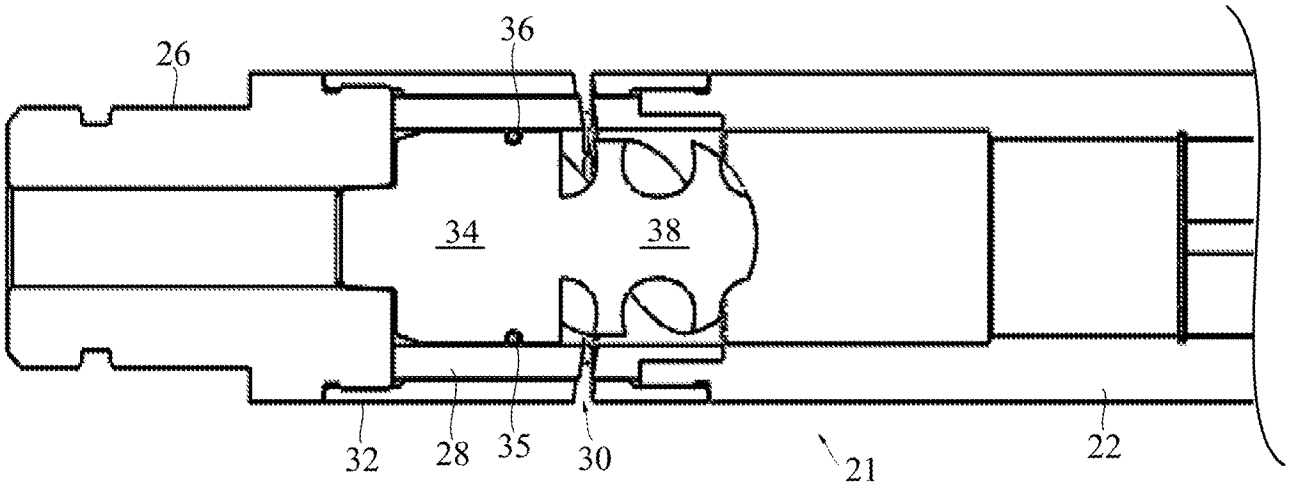
FIG. 7 is an enlarged cross-sectional view of the nozzle section of the apparatus shown in FIG. 4, with the nozzles in an open position according to an embodiment.
Figure 5:
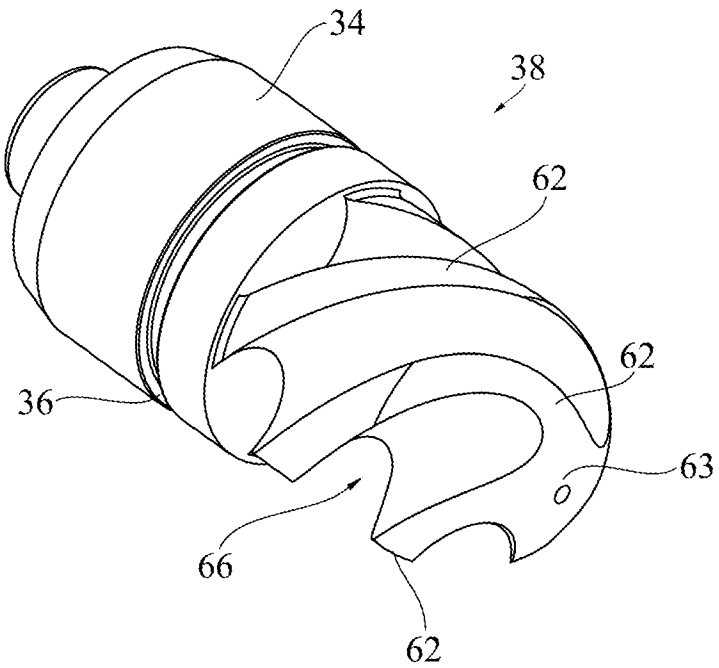
FIG. 5 is an upper end perspective view of the swirl generator shown in FIG. 4, according to an embodiment.
Figure 6:
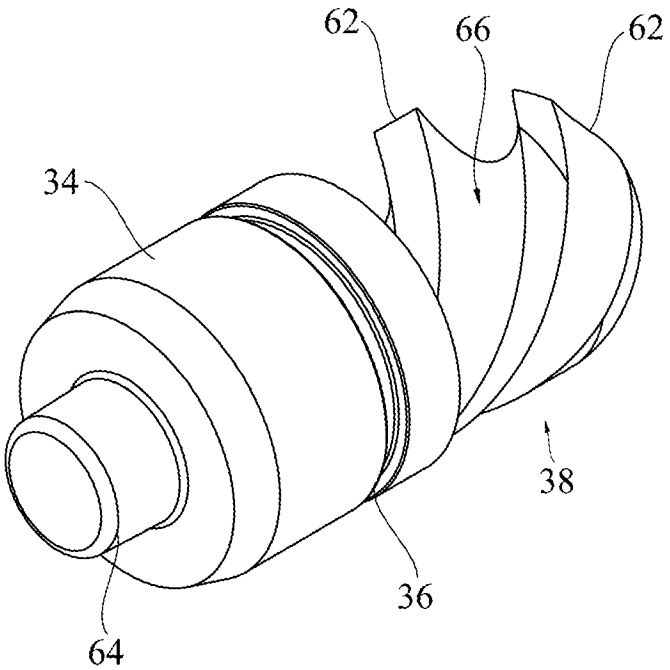
FIG. 6 is a lower end perspective view of the swirl generator shown in FIG. 4 according to an embodiment.

FIG. 4 is an enlarged cross-sectional view of the nozzle section 21 of the apparatus 10 shown in FIG. 1. FIG. 5 is an upper end perspective view of the swirl generator 38, and FIG. 6 is a lower end perspective view of the swirl generator 38. These figures show that the swirl generator 38 may comprise a plurality of helical vanes 62 which extend from a domed end 63 of the swirl generator 38 to the piston 34. The plurality of helical vanes 62 form helical grooves 66 between adjacent vanes 62. The dome shape of the domed end 63 creates laminar flow of the matrix of combustion products across the surface of the helical vanes 62 as the matrix of combustion products enters the helical grooves 66. In the embodiment of FIGS. 4-7, the bottom portion of the grooves comprises a concave surface. The helical vanes 62 and the helical grooves 66 between the helical vanes 62 are shaped to rotate the matrix of combustion products and direct the rotating matrix of combustion products radially outward of the elongated nozzle apertures 30 and the apparatus 10 for cutting the drill pipe 12 in the borehole 14. That is, the matrix of combustion products may be rotated by the helical shape of the vanes 62 and/or the helical shape of the grooves 66 as the matrix of combustion products passes in the helical grooves 66 between the helical vanes 62 of the swirl generator 38. When the activation device 44 is energize by electrical current, the activation device 44 generates enough heat to ignite the combustible material 42—and hence the pellets 40—to generate a very high temperature matrix of combustion products and pressure that produce a force which moves the swirl generator 38 from the first initial position shown in FIG. 4 toward the elongated nozzle apertures 30 as the matrix of combustion products passes in the helical groves 66 between the helical vanes 62. Such movement of the swirl generator 38 forces the piston 34 downward below the elongated nozzle apertures 30, as shown in FIG. 7, to allow the high temperature matrix of combustion products to flow out of the cavity of the lower chamber portion 24*c* by way of the elongated nozzle apertures 30. The high temperature matrix of combustion products exits the elongated nozzle apertures 30 to impinge the drill pipe 12 to cut or sever the drill pipe 12 at the level of the apertures 30. Because of the twisting shape of the helical vanes 62 and/or grooves 66, a rotational thrust is generated upon the helical vanes 62 and/or helical grooves 66 by the matrix of combustion products. As a result, a reverse thrust reaction on the apparatus 10 is produced, imparting a degree of rotation with respect to the axis of the apparatus 10. The degree of rotation may be anywhere from 1 degree to 30 degrees. In one embodiment, the degree of rotation may range from 5 degrees to 7 degrees. In other embodiments, the degree of rotation may be around 10 degrees, around 15 degrees, around 20 degrees, around, 25 degrees, or around 30 degrees. The matrix of combustion products may impact the drill pipe 12 at an incident angle (i.e., other than at a normal angle) or at a sweeping angle. As discussed above, the matrix of combustion products passing along the helical vanes 62 and/or in the grooves 66 between the helical vanes 62 of the swirl generator 38 produces a reverse thrust that acts upon the apparatus 10 to rotate the apparatus 10 about its axis, which may create a more even cutting pattern minimize over-shutting potential, and reduce or eliminate webbing effects. The swirl generator 38 may be formed of a high strength heat resistant material such: as ceramics, e.g., Alumina, Aluminum Nitride, Boron Carbide, Silicon Carbide or Zirconia; carbon material; and high melting material, such as tungsten.

In the embodiment illustrated in FIGS. 5 and 6, the swirl generator 38 includes a total of four helical vanes 62. In other embodiments however, the swirl generator 38 may include a total of two, three or five or more helical vanes 62. As best shown in FIG. 6, the opposite end 64 of the swirl generator 38 has a diameter that is smaller than the domed end 63 (see FIG. 5) of the swirl generator 38. The small diameter is intended to form a pressure seal when it is forced into the central bore of the cap 26 (FIG. 7) by the pressure generated within the apparatus during combustion of the fuel.

A method of utilizing the apparatus 10 discussed herein to cut or sever the drill pipe 12 located in the borehole 14 may include combusting combustible material 42, and hence the pellets 40, to produce a matrix of combustion products, which flow in the grooves 66 between the helical vanes 62 of the swirl generator 38 to move the swirl generator 38 with a force. The force moves the piston 34 of the swirl generator 38 into the lower chamber portion 24*e* of the nozzle section 21, so that the piston 34 moves below the plurality of elongated apertures 30 for passage of the matrix of combustion products from the swirl generator 38 into the lower chamber portion 24*c* and out of the plurality of elongated apertures 30 for cutting or severing the drill pipe 12. As discussed above, the matrix of combustion products passing along the helical vanes 62 and/or in the grooves 66 between the helical vanes 62 of the swirl generator 38 produces a reverse thrust that acts upon the apparatus 10 to rotate the apparatus 10 about its axis, which may create a more even cutting pattern, minimize over-cutting potential, and reduce or eliminate webbing effects.

After the drill pipe 12 has been cut or severed, the apparatus 10 may be removed from the borehole 14, allowing the upper portion of the drill pipe 12 to be removed and the lower portion of the drill pipe 12 to then be drilled out in the event that the drill pipe 12 had become stuck in the borehole 14. The apparatus 10 may be used to cut or sever conventional metal production tubing, metal coiled tubing, or metal casing in a borehole for remedial purposes. In FIG. 1, the apparatus 10 shown is employed to cut or sever metal casing 12 located in the borehole 14.

Figure 8:
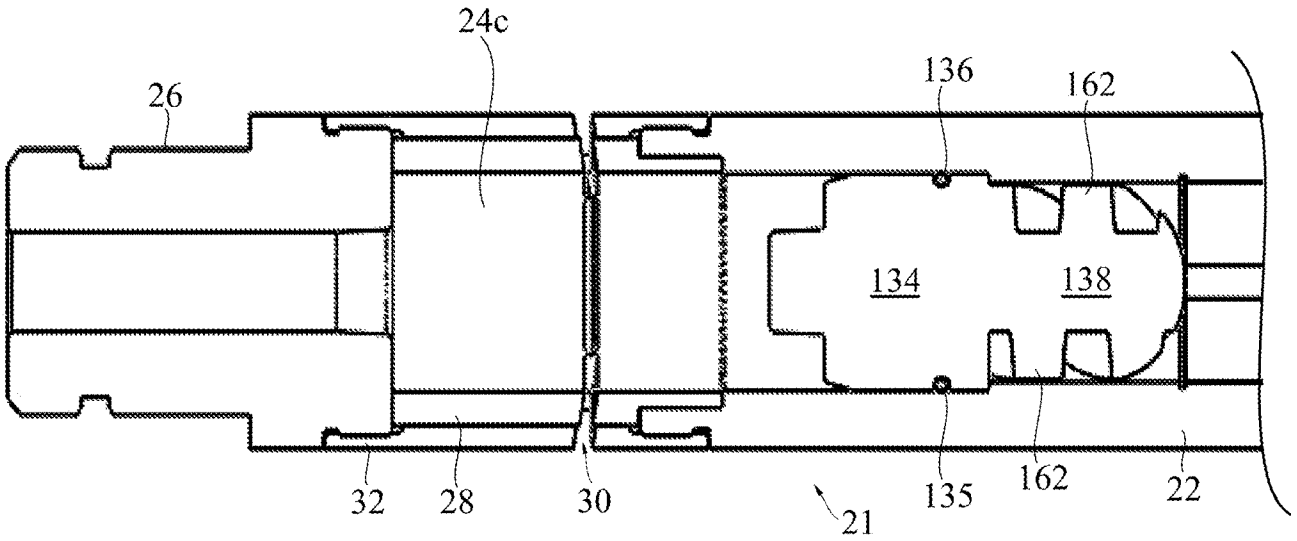
FIG. 8 is an enlarged cross-sectional view of the nozzle section of the apparatus shown in FIG. 1, according to another embodiment.
Figure 11:
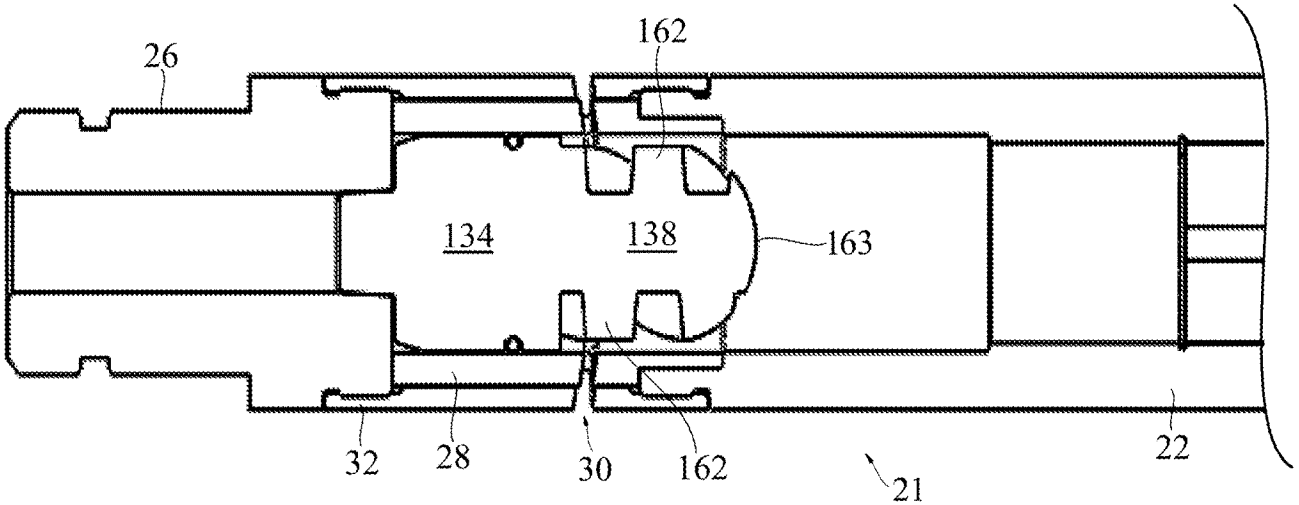
FIG. 11 is an enlarged cross-sectional view of the nozzle section of the apparatus shown in FIG. 8, with the nozzles in an open position.
Figure 10:
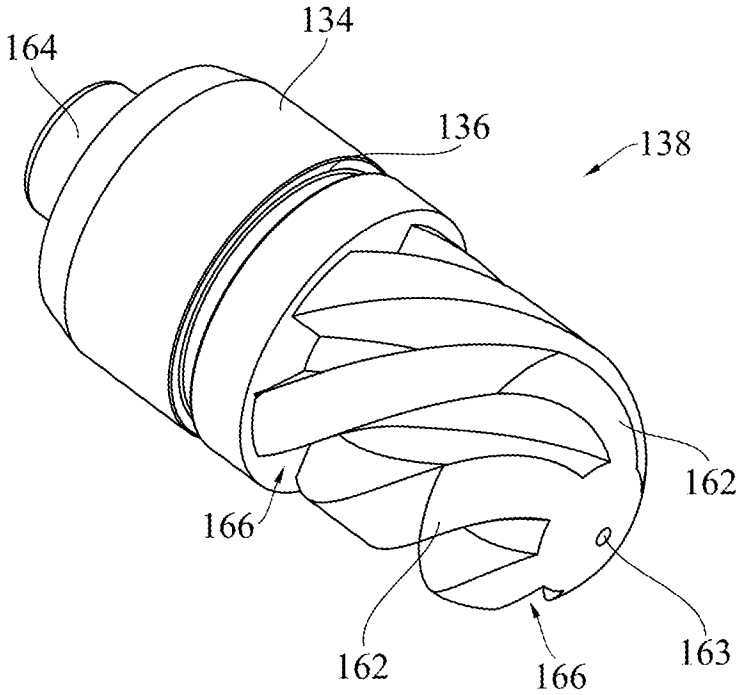
FIG. 10 is an upper end perspective view of the swirl generator shown in FIG. 8.
Figure 9:
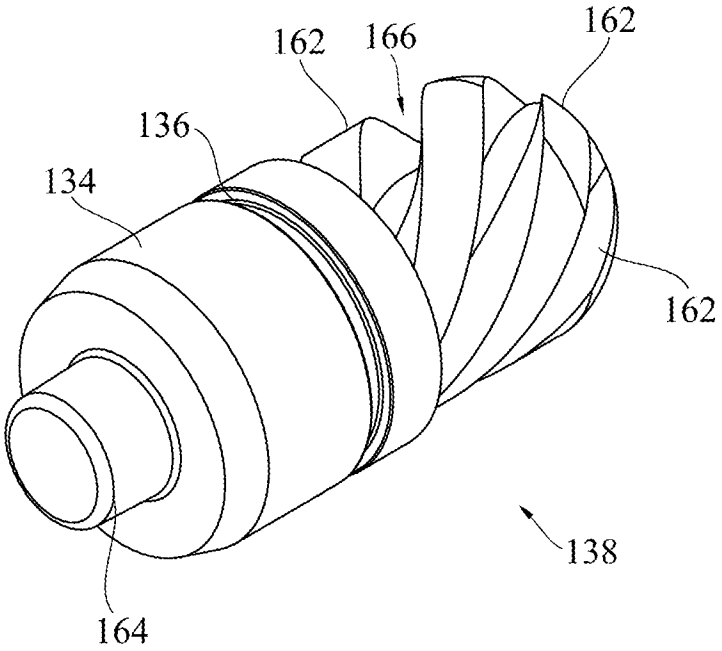
FIG. 9 is a lower end perspective view of the swirl generator shown in FIG. 8.

FIGS. 8-11 illustrate another embodiment of a swirl generator 138. FIGS. 8 and 11 show the nozzle section 21 of the apparatus 10, which may be the same apparatus 10 as in the embodiments of FIGS. 1-4 and 7, with exception that the swirl generator 38 in those embodiments is replaced with the swirl generator 138 of a second embodiment. Thus, the reference numerals designating elements of the apparatus 10 in FIGS. 8 and 11 are the same as those in FIGS. 4 and 7. As shown in FIGS. 9 and 10, the swirl generator 138 comprises a plurality of helical vanes 162 which may extend from a domed end 163 of the swirl generator 138 to the piston 134. In some embodiments, the swirl generator 138 may be bonded to the piston 134, or may be pinned and bonded to the piston 134. The piston 134 may be formed of high strength steel. The plurality of helical vanes 162 form helical grooves 166 between adjacent vanes 162. The dome shape of the domed end 163 creates laminar flow of the matrix of combustion products across the surface of the helical vanes 162 as the matrix of combustion products enters the helical grooves 166. A sealing ring 135, such as an O-ring, may be provided in an annular slot 136 in the piston 134. The sealing ring 135, along with liquid pressure in the lower chamber portion 24*c*, may initially hold the swirl generator 138 in a first initial position above the elongated nozzle apertures 30. In the embodiment of FIGS. 8-11, the bottom portion of the grooves comprises a convex surface. The helical vanes 162 and the helical grooves 166 are shaped to rotate the high temperature matrix of combustion products and direct the rotating matrix of combustion products radially outward of the elongated nozzle apertures 30 and the apparatus 10 for cutting or severing the drill pipe 12 in the borehole 14. That is, the matrix of combustion products may be rotated by the helical shape of the vanes 162 and/or the grooves 166 as the matrix of combustion products passes along and/or between the helical vanes 162 of the swirl generator 138.

When the activation device 44 is energize by electrical current, the activation device 44 generates enough heat to ignite the combustible material 42 and hence the pellets 40 to generate a very high temperature matrix of combustion products and pressure that produce a force which moves the swirl generator 138 from the first initial position shown in FIG. 8 toward the elongated nozzle apertures 30 as the matrix of combustion products passes in the grooves 166 between the helical vanes 162. Such movement of the swirl generator 138 forces the piston 134 downward below the elongated nozzle apertures 30, as shown in FIG. 11, to allow the high temperature matrix of combustion products to flow out of the cavity of the lower chamber portion 24*c* by way of the elongated nozzle apertures 30. The high temperature matrix of combustion products exits the elongated nozzle apertures 30 to impinge the drill pipe 12 to cut or sever the drill pipe 12 at the level of the apertures 30. Because of the twisting shape of the helical vanes 162 and/or grooves 166, a rotational thrust is generated upon the helical vanes 162 and/or helical grooves 166 by the matrix of combustion products. As a result, a reverse thrust reaction on the apparatus 10 is produced, imparting a degree of rotation with respect to the axis of the apparatus 10. The degree of rotation may be anywhere from 1 degree to 30 degrees. In one embodiment, the degree of rotation may range from 5 degrees to 7 degrees. In other embodiments, the degree of rotation may be around JO degrees, around 15 degrees, around 20 degrees, around, 25 degrees, or around 30 degrees. The matrix of combustion products may impact the drill pipe 12 at an incident angle (i.e., other than at a normal angle) or at a sweeping angle. As discussed above, the matrix of combustion products passing along the helical vanes 162 and/or in the grooves 166 between the helical vanes 162 of the swirl generator 138 produces a reverse thrust that acts upon the apparatus 10 to rotate the apparatus 10 about its axis, which may create a more even cutting pattern, minimize over-cutting potential, and reduce or eliminate webbing effects. The swirl generator 138 may be formed of a high strength heat resistant material such: as ceramics, e.g., Alumina, Aluminum Nitride, Boron Carbide, Silicon Carbide or Zirconia; carbon material: and high melting material, such as tungsten.

In the embodiment illustrated in FIGS. 9 and 10, the swirl generator 138 includes a total of four helical vanes 162. In other embodiments however, the swirl generator 138 may include a total of two, three or five or more helical vanes 162. As best shown in FIG. 9, the opposite end 164 of the swirl generator 138 has a diameter that is smaller than the domed end 163 (see FIG. 10) of the swirl generator 138. The small diameter is intended to form a pressure seal when it is forced into the aperture in 26 (FIG. 7) by the pressure generated within the apparatus during combustion of the fuel.

A slickline battery firing system may be employed in lieu of the electric line firing system to energize the activation device 44, according to another embodiment. Such a system comprises a slickline cable connection for supporting the modified apparatus 10 and which is connected to a pressure firing head. The pressure firing head may comprise a metal piston having a larger diameter head with a smaller diameter metal rod extending downward from the bottom of the larger diameter head. The piston may be slidably located in a hollow cylinder. A spring surrounding the rod is employed to provide upward pressure against the underside of the larger diameter head. The spring may be adjustable to allow for hydrostatic compensation of well fluids so that the system does not lire at bottom hole pressure. When the piston is moved downward, the lower end of the rod will make contact with an electrical lead from the battery pack and electrical lead coupled to one side of the activation device (the negative terminal of the battery pack and the other side of the activation device are grounded) to discharge current to the activation device to ignite the combustible material 42 and fire the combustible pellets 40. Fluid ports may extend through the wall of the cylinder above the larger diameter piston head. When the borehole apparatus is in place in the borehole ready to cut the metal conduit, a pump at the surface increases the fluid pressure in the conduit and moves the piston downward against the pressure of the spring to allow the rod to make electrical contact with the leads to file the combustible pellets 40.

In another embodiment, a slickline percussion firing system may be employed in lieu of the electric line firing system to ignite the combustible pellets 40. This system comprises a slickline cable head connection for supporting the modified apparatus 10 and which is connected to a pressure firing subassembly. The pressure firing subassembly comprises a cylinder having the piston and spring described in connection with the battery firing system. Ports are formed through the cylinder wall above the piston. Fluid pressure is increased, to force the piston rod (firing pin)

against a lower percussion firing cap which ignites upon impact to ignite the combustible pellets 40.

Still further, a percussion firing system run via coiled tubing, production tubing, or drill pipe may be employed in lieu of the electric firing system to ignite the combustible pellets 40. This system comprises coiled tubing for supporting the modified apparatus 10 connected to a connector subassembly which connects to a pressure firing head which comprises a hollow cylinder with a piston located therein and supported by shear pins. The coiled tubing may be coupled to the interior of the cylinder at its upper end. The piston may have a central flow path extending axially downward from its upper end and then radially outward through the cylinder wall. A firing pin extends from the lower end of the piston. The flow path allows the coiled tubing to fill with water as the assembly is lowered downhole and also allows for circulation of fluid in running of the assembly. When the apparatus is at the desired cutting depth, a ball is dropped into the tubing which passes to the piston, plugging the flow path allowing an increase in fluid pressure to be achieved in the tubing and upper end of the cylinder which shears the shear pins driving the firing pin into the percussion cap to ignite the combustible pellets 40.

Figure 12:
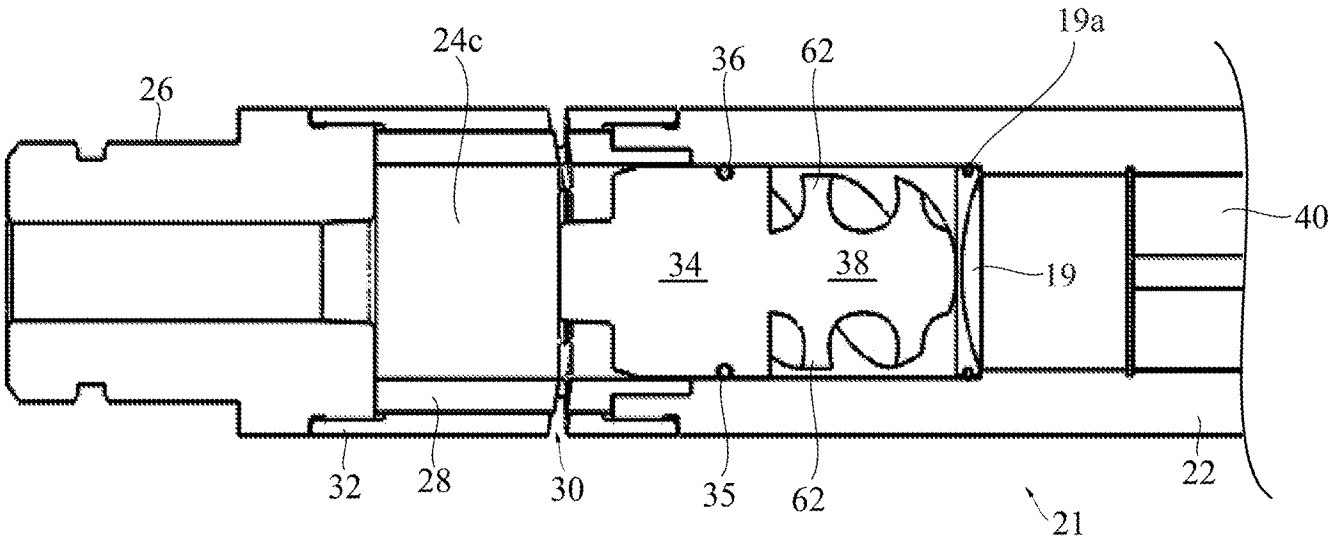
FIG. 12 is an enlarged cross-sectional view of the nozzle section of the apparatus shown in FIG. 1, according to a further embodiment.
Figure 13:
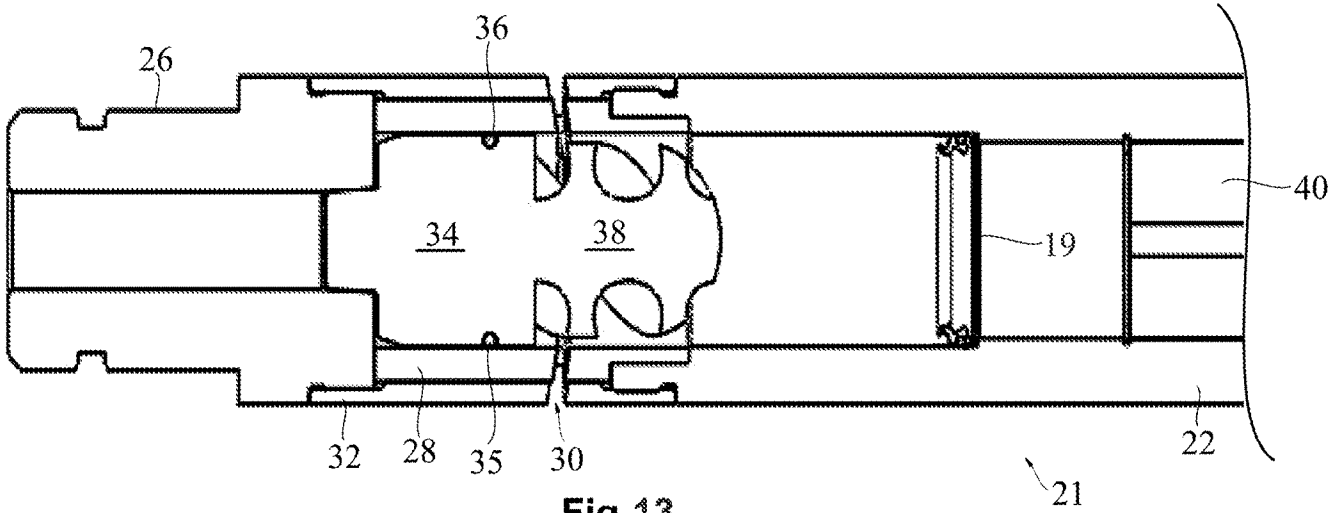
FIG. 13 is an enlarged cross-sectional view of the nozzle section of the apparatus shown in FIG. 12, with the nozzles in an open position.

FIGS. 12 and 13 illustrate an enlarged cross-sectional view of another embodiment of the nozzle section 21 of the apparatus 10. The nozzle section 21 is similar to the nozzle section 21 illustrated in FIGS. 4 and 7 except that the nozzle section 21 in FIGS. 12 and 13 includes a rupture disc 19 located between the combustible fuel 40 and the swirl generator 38. Other components of the nozzle section 21 in FIGS. 12 and 13, which are the same as in the FIGS. 4 and 7 embodiment, are numbered with the same reference numerals. The rupture disc 19 may be fixed within the lower chamber portion 24*c* via, e.g., a snap-ring 19*a* or similar device. The rupture disc 19 may be located at a distance from the combustible fuel 40 and/or may abut or be adjacent to the domed end 63 of the swirl generator 38. The rupture disc 19 is configured to withstand a hydrostatic pressure that exists within the borehole 14. The rupture disc 19 in one embodiment is configured to be breached when the matrix of combustion products generates sufficient pressure, and/or a predetermined pressure, to break the rupture disc 19 and allow the matrix of combustion products to be directed onto the swirl generator 38 and flow between and/or along the plurality of helical vanes 62 of the swirl generator 38. In another embodiment, the rupture disc 19 may be configured to dissolve or erode via interaction with the matrix of combustion products. In some embodiments, the rupture disc 19 may be formed as a plug with a breakable, dissolvable, and/or erodible disc provided therein. The activation device 44, when energized by electrical current as discussed above, generates enough heat to ignite the combustible material 42—and hence the pellets 40—to generate the high temperature matrix of combustion products and pressure that produce a force which moves the swirl generator 38 from the first initial position shown in FIG. 12 toward the elongated nozzle apertures 30 as the matrix of combustion products passes in the helical grooves 66 between the helical vanes 62. Such movement of the swirl generator 38 forces the piston 34 downward within the lower chamber portion 24*c* below the elongated nozzle apertures 30, as shown in FIG. 13, to allow the high temperature matrix of combustion products to flow out of the cavity of the lower chamber portion 24*e* by way of the elongated nozzle apertures 30.

The high temperature matrix of combustion products exits the elongated nozzle apertures 30 to impinge the drill pipe 12 to cut or sever the drill pipe 12 at the level of the apertures 30. As in the other embodiments discussed herein, each of the plurality of helical vanes 62 is shaped to rotate the matrix of combustion products and direct the rotating matrix of combustion products radially through the plurality of apertures 30 for cutting the drill pipe 12 in the borehole 14. Further, as in the other embodiments discussed herein, the matrix of combustible products acts upon the helical vanes 62 of the swirl generator 38 to produce a rotational thrust which is imparted to the apparatus 10, which generates a rotational movement of the apparatus 10 about the central axis. The rotational movement may be between 1 degree and 30 degrees about the central axis, as discussed above. The matrix of combustion products may impact the drill pipe 12 at an incident angle (i.e., other than at a normal angle) or at a sweeping angle. As discussed above, the matrix of combustion products passing along the helical vanes 62 and/or in the grooves 66 between the helical vanes 62 of the swirl generator 38 produces a reverse thrust that acts upon the apparatus 10 to rotate the apparatus 10 about its axis, which may create a more even cutting pattern, minimize overcutting potential, and reduce or eliminate webbing effects. The swirl generator 38 may be formed of a high strength heat resistant material such: as ceramics, e.g., Alumina, Aluminum Nitride, Boron Carbide, Silicon Carbide or Zirconia; carbon material; and high melting material, such as tungsten.

Figure 14:
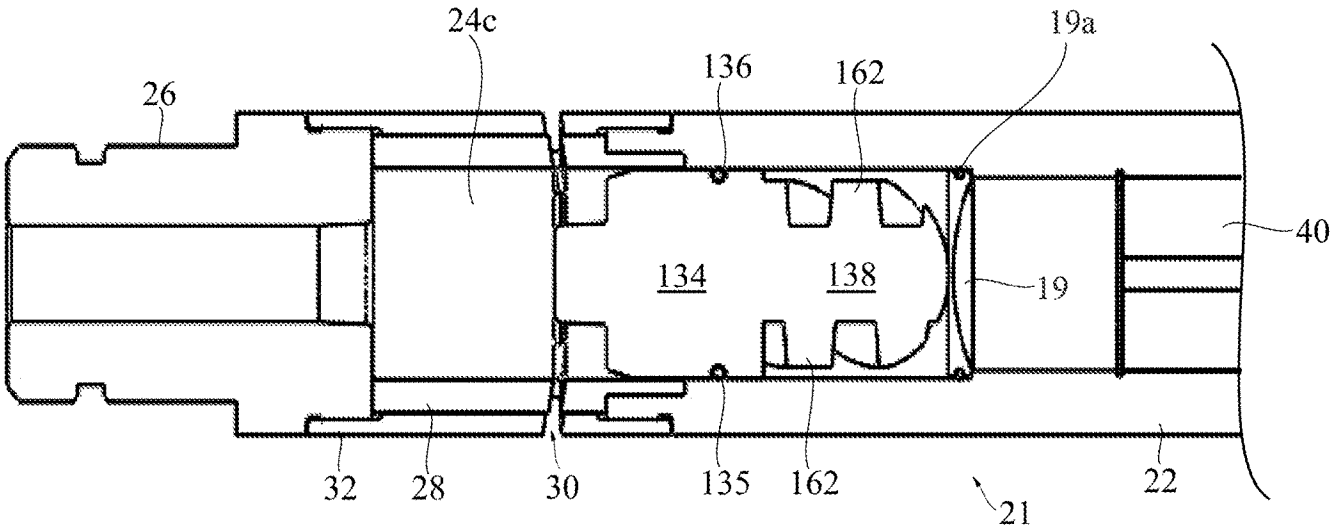
FIG. 14 is an enlarged cross-sectional view of the nozzle section of the apparatus shown in FIG. 1, according to a still further embodiment.
Figure 15:
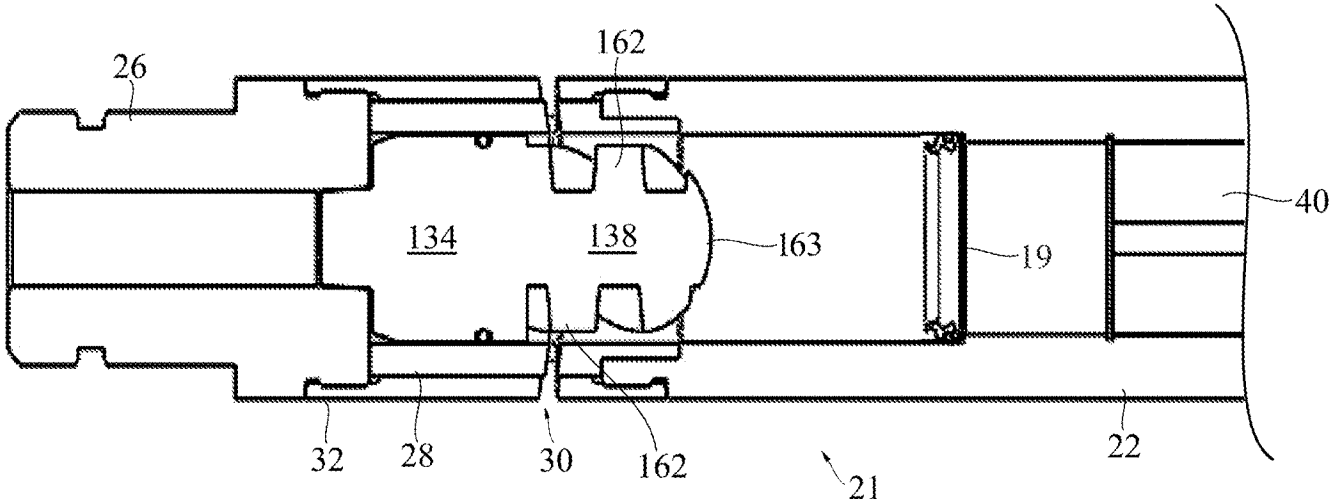
FIG. 15 is an enlarged cross-sectional view of the nozzle section of the apparatus shown in FIG. 14, with the nozzles in an open position.

FIGS. 14 and 15 illustrate an enlarged cross-sectional view of a further embodiment of the nozzle section 21 of the apparatus 10. The nozzle section 21 is similar to the nozzle section 21 illustrated in FIGS. 12 and 13 except that the swirl generator 38 is replaced with the swirl generator 138 and piston 134 of FIGS. 9 and 10. Other components of the nozzle section 21 in FIGS. 14 and 15 that are the same as in the FIGS. 12 and 13 embodiment are numbered with the same reference numerals. The rupture disc 19 may be fixed within the lower chamber portion 24*c* via, e.g., a snap-ring 19*a* or similar device. The rupture disc 19 may be located at a distance from the combustible fuel 40 and/or may abut or be adjacent to the domed end 163 of the swirl generator 138. The rupture disc 19 is configured to withstand a hydrostatic pressure that exists within the borehole 14. The rupture disc 19 in one embodiment is configured to be breached when the matrix of combustion products generates sufficient pressure, and/or a predetermined pressure, to break the rupture disc 19 and allow the matrix of combustion products to be directed onto the swirl generator 138 and flow between and/or along the plurality of helical vanes 162 of the swirl generator 138. In another embodiment, the rupture disc 19 may be configured to dissolve or erode via interaction with the matrix of combustion products. In some embodiments, the rupture disc 19 may be formed as a plug with a breakable, dissolvable, and/or erodible disc provided therein. As discussed above, the activation device 44 generates enough heat to ignite the combustible material 42—and hence the pellets 40—to generate the high temperature matrix of combustion products and pressure that produce a force which moves the swirl generator 138 from the first initial position shown in FIG. 14 toward the elongated nozzle apertures 30 as the matrix of combustion products passes in the helical grooves 66 between the helical vanes 62. Such movement of the swirl generator 138 forces the piston 134 downward within the lower chamber portion 24*c* below the elongated nozzle apertures 30, as shown in FIG. 15, to allow the high temperature matrix of combustion products to flow out of the cavity of the lower chamber portion 24*c* by way of the elongated nozzle apertures 30.

Figure 16:
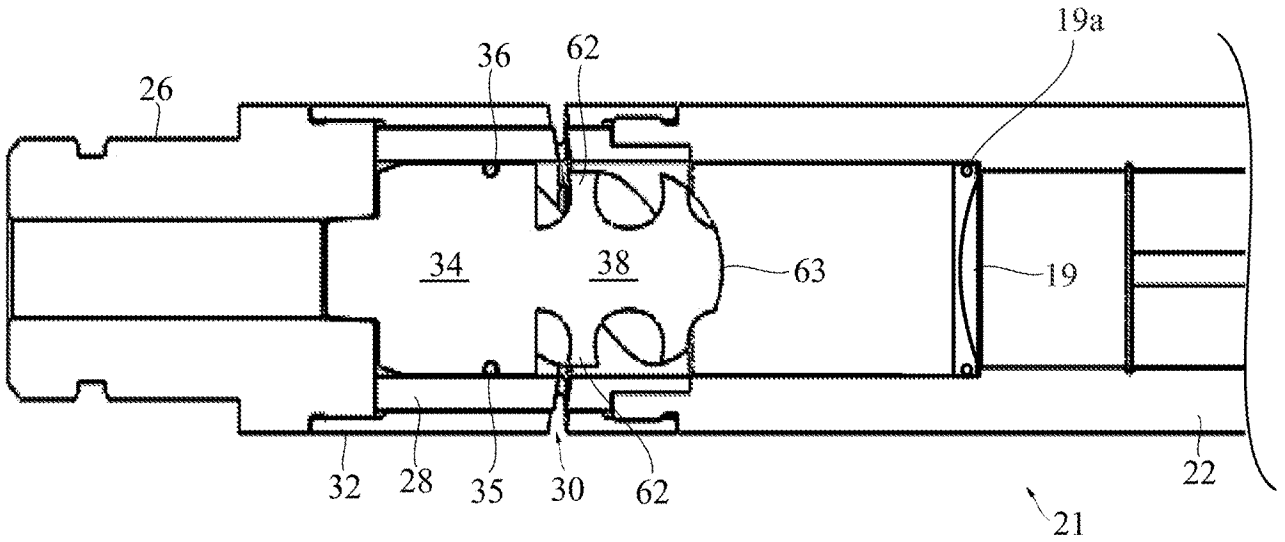
FIG. 16 is illustrates an enlarged cross-sectional view of the nozzle section of the apparatus shown in FIG. 1, according to another embodiment.
Figure 17:
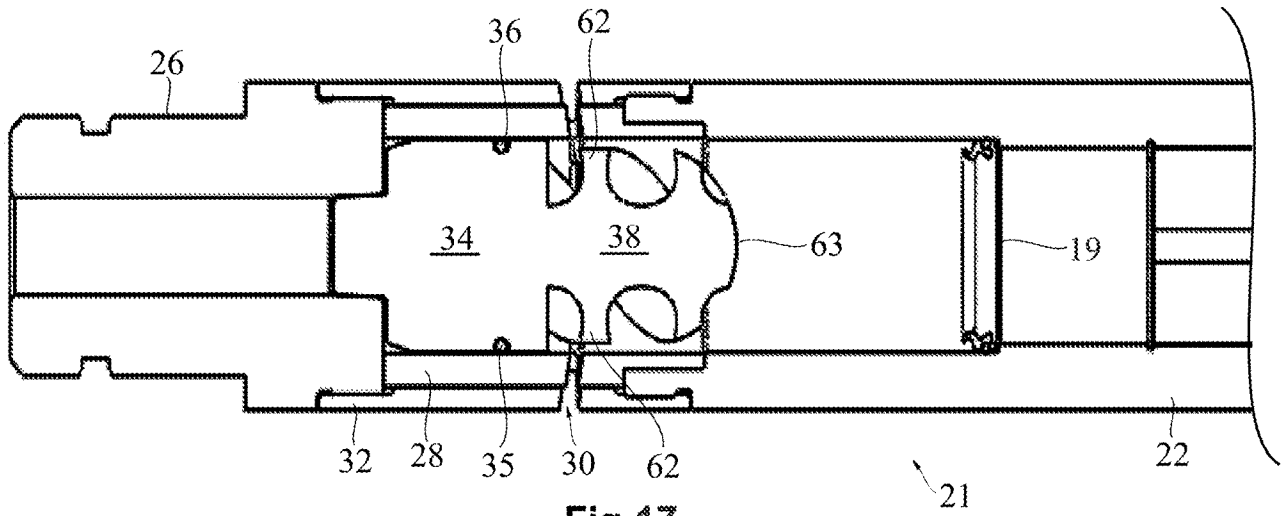
FIG. 17 is illustrates another enlarged cross-sectional view of the nozzle section of the apparatus shown in FIG. 16.

FIGS. 16 and 17 illustrate yet a further embodiment of an apparatus 10. FIG. 16 shows the nozzle section 21 of the apparatus 10, which may be the same apparatus 10 as in the embodiments of FIGS. 1-11, with exception that the apparatus 10 includes a rupture disc 19 located between the combustible fuel 40 and the swirl generator 38. Other components of the nozzle section 21 in FIGS. 16 and 17, which are the same as in the FIGS. 1-11 embodiments are numbered with the same reference numerals. The rupture disc 19 may be fixed within the lower chamber portion 24*c* via, e.g., a snap-ring 19*a* or similar device. In this embedment, the swirl generator 38 is fixed within the lower chamber portion 24*c* such that the plurality of apertures 30 is set in the open position. In the illustrated configuration, the combustible fuel 40 is separated from the swirl generator 38 by the rupture disc 19. The rupture disc 19 may be located at a distance from the combustible fuel 40 and/or at a distance to the domed end 63 of the swirl generator 38. The rupture disc 19 is configured to withstand a hydrostatic pressure that exists within the borehole 14. The rupture disc 19 in one embodiment is configured to be breached when the matrix of combustion products generates sufficient pressure, or a predetermined pressure, to break the rupture disc 19 and allow the matrix of combustion products to be directed onto and flow between and/or along the plurality of helical vanes 62 of the swirl generator 38. In another embodiment, the rupture disc 19 may be configured to dissolve or erode via interaction with the matrix of combustion products. In some embodiments, the rupture disc 19 may be formed as a plug with a breakable, dissolvable, and/or erodible disc provided therein. When the activation device 44 generates enough heat to ignite the combustible material 42—and hence the pellets 40 to generate the high temperature matrix of combustion products and pressure, the high temperature matrix of combustion products and pressure breaks and/or dissolves/erodes, as shown in FIG. 17, to allow the matrix of combustion products to be directed onto and flow between and/or along the helical grooves 66 between the helical vanes 62 of the swirl generator 38. As the swirl generator 38 is fixed within the lower chamber portion 24*c* so that the plurality of apertures 30 are in the open position, the high temperature matrix of combustion products can flow out of the cavity of the lower chamber portion 24*c* by way of the elongated nozzle apertures 30.

As in the other embodiments discussed herein, each of the plurality of helical vanes 62 is shaped to rotate the matrix of combustion products and direct the rotating matrix of combustion products radially through the plurality of apertures 30 for cutting the drill pipe 12 in the borehole 14. Further, as in the other embodiments discussed herein, the matrix of combustible products acts upon the helical vanes 62 of the swirl generator 38 to produce a rotational thrust which is imparted to the apparatus 10, which generates a rotational movement of the apparatus 10 about the central aids. The rotational movement may be between 1 degree and 30 degrees about the central axis, as discussed above. The apparatus 10 of FIGS. 16 and 17 thus has no moving parts as in the previous embodiments discussed herein, and thus may have a more reliable configuration.

While various embodiments usable within the scope of the present disclosure have been described with emphasis, it should be understood that within the scope of the appended claims, the present invention can be practiced other than as specifically described herein.

What is claimed is:

1. An apparatus for severing a conduit in a borehole, comprising:

a body adapted to be lowered into the conduit and comprising a central axis;

a combustible fuel located within the body;

a nozzle section comprising a cavity with a plurality of apertures for providing passages from the cavity to outside of the body;

a movable swirl generator located between the combustible fuel and the nozzle section, the swirl generator comprising a piston and a plurality of helical vanes which extend from one end of the swirl generator toward the piston, wherein the piston is located initially above the plurality of apertures; and an activation device for igniting the combustible fuel to create a matrix of combustion products that pass between and/or along the plurality of helical vanes and move the swirl generator in the cavity so that the piston is moved below the plurality of apertures for passage of the matrix of combustion products into the cavity and out of the plurality of apertures for severing the conduit, wherein each of the plurality of helical vanes is shaped to rotate the matrix of combustion products and direct the rotating matrix of combustion products radially through of the plurality of apertures for cutting the conduit in the borehole.

2. The apparatus of claim 1, wherein the matrix of combustible products acts upon the helical vanes of the swirl generator to produce a rotational thrust that is imparted to the apparatus, which generates a rotational movement of the apparatus about the central axis.

3. The apparatus of claim 2, wherein the rotational movement is between 1 degree and 30 degrees about the central axis.

4. The apparatus of claim 1, wherein the swirl generator comprises at least two helical vanes.

5. The apparatus of claim 1, wherein the combustible fuel is one of a solid, a liquid, and a gel.

6. The apparatus of claim 1, wherein the combustible fuel is configured to be inserted into the body at a work site, to allow for the combustible fuel to be tailored to specific well conditions, operational requirements, and/or constraints.

7. The apparatus of claim 1, wherein an end of the swirl generator that is opposite the piston is dome shaped.

8. A method of cutting a conduit located in a borehole, comprising:

combusting a material to produce a matrix of combustion products within an apparatus comprising a central axis;

flowing the matrix of combustion products between and/or along a plurality of helical vanes of a swirl generator;

moving, with a force of the matrix of combustion products, the swirl generator in a cavity of a nozzle section comprising plurality of apertures, so that a piston portion of the swirl generator moves below the plurality of apertures for passage of the matrix of combustion products from the swirl generator into the cavity and out of the plurality of apertures for severing the conduit, wherein the plurality of helical vanes rotate the matrix of combustion products and direct the rotating matrix of combustion products radially through of the plurality of apertures for cutting the conduit in the borehole.

9. The method of claim 8, wherein the matrix of combustible products acts upon the helical vanes of the swirl generator to produce a rotational thrust that is imparted to the apparatus, which generates a rotational movement of the apparatus about the central axis.

10. The method of claim 9, wherein the rotational movement is between t degree and 30 degrees about the central axis.

11. The method of claim 8, wherein the material that is combusted is one of a solid, a liquid, and a gel.

12. The method of claim 8, further comprising inserting the material that is combusted is inserted into the apparatus at a work site, to allow for the material to be tailored to specific well conditions, operational requirements, and/or constraints.

13. An apparatus for severing a conduit in a borehole, comprising:

a nozzle section comprising a cavity with a plurality of apertures for providing passages from the cavity to outside of the apparatus; and a swirl generator adjacent the nozzle section and comprising a piston and a plurality of helical vanes which extend from one end of the swirl generator to the piston, wherein the piston is located initially above the plurality of apertures, the swirl generator is configured to move in the cavity to position the piston below the plurality of apertures for passage of a matrix of combustion products into the cavity and out of the plurality of apertures for severing the conduit, and each of the plurality of helical vanes is shaped to rotate the matrix of combustion products, and direct the rotating matrix of combustion products radially through of the plurality of apertures when the piston is moved below the plurality of apertures.

14. The apparatus of claim 13, further comprising a central axis, wherein the matrix of combustible products acts upon the helical vanes of the swirl generator to produce a rotational thrust which is imparted to the apparatus, which generates a rotational movement of the apparatus about the central axis.

15. The apparatus of claim 14, wherein the rotational movement is between 1 degree and 30 degrees about the central axis.

16. The apparatus of claim 14, wherein the swirl generator comprises at least two helical vanes.

17. The apparatus of claim 14, wherein an end of the swirl generator that is opposite the piston is dome shaped.

18. An apparatus for severing a conduit in a borehole, comprising:

a body adapted to be lowered into the conduit and comprising a central axis;

a combustible fuel located within the body;

a nozzle section comprising a plurality of apertures for providing passages to outside of the body;

a swirl generator located within the nozzle section and comprising a plurality of helical vanes;

an activation device for igniting the combustible fuel to create a matrix of combustion products; and a rupture disc located between the combustible fuel and the swirl generator, wherein the rupture disc is configured to break under a predetermined pressure from the matrix of combustion products and allow passage of the matrix of combustion products through the rupture disc and flow along the plurality of helical vanes of the swirl generator, and wherein each of the plurality of helical vanes is shaped to rotate the matrix of combustion products and direct the rotating matrix of combustion products radially through the plurality of apertures for cutting the conduit in the borehole.

19. The apparatus of claim 18, wherein the matrix of combustible products acts upon the helical vanes of the swirl generator to produce a rotational thrust which is imparted to the apparatus, which generates a rotational movement of the apparatus about the central axis.

20. The apparatus of claim 19, wherein the rotational movement is between 1 degree and 30 degrees about the central axis.

* * * * *